US006822241B2

(12) United States Patent
Schut et al.

(10) Patent No.: US 6,822,241 B2
(45) Date of Patent: Nov. 23, 2004

(54) EMITTER DEVICE WITH FOCUSING COLUMNS

(75) Inventors: David Schut, Philomath, OR (US); Alexander Govyadinov, Corvallis, OR (US); Xioofeng Yang, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/264,599

(22) Filed: Oct. 3, 2002

(65) Prior Publication Data

US 2004/0065843 A1 Apr. 8, 2004

(51) Int. Cl.[7] ..... H01J 3/06; H01J 3/14
(52) U.S. Cl. ..... 250/398; 250/492.2; 313/409
(58) Field of Search ..... 250/492.1, 396, 250/396 R, 398, 458.1; 313/495, 309, 336, 351, 497, 307, 422, 308

(56) References Cited

U.S. PATENT DOCUMENTS 5,633,507 A 5/1997 Pfeiffer et al.
5,691,541 A 11/1997 Ceglio et al.
5,726,530 A * 3/1998 Peng ..... 313/495
5,895,580 A * 4/1999 Liu et al. ..... 216/11
5,981,962 A 11/1999 Groves et al.
6,194,838 B1 2/2001 Beeteson et al.
6,333,508 B1 12/2001 Katsap et al.
6,400,090 B2 6/2002 Katsap et al.
6,464,337 B2 * 10/2002 Roy et al. ..... 347/46
6,556,349 B2 * 4/2003 Cox et al. ..... 359/626
2003/0122091 A1 * 7/2003 Almogy ..... 250/492.24

FOREIGN PATENT DOCUMENTS

WO WO 98/48443 * 10/1998 ..... H01J/37/30

* cited by examiner

*Primary Examiner*—Nikita Wells
*Assistant Examiner*—James P. Hughes

(57) ABSTRACT

An emitter device including a focusing array with plural focusing columns to focus emissions from one or more emitters onto a target medium. Relative movement between the target medium and the focused emissions allows each focusing column to focus emissions over an area of the target medium encompassing the movement range. In a preferred embodiment, separate emitter, focusing array and target medium substrates are used. The focusing array may be moveable, or in a particularly preferred embodiment, is affixed to the emitter substrate, in which case the target medium substrate is movable or the focusing array includes beam direction control.

30 Claims, 19 Drawing Sheets

EMITTER DEVICE WITH FOCUSING COLUMNS

FIELD OF THE INVENTION

The invention is in the microelectronics field and is particularly concerned with devices making use of focused emissions from electron emitters.

BACKGROUND OF THE INVENTION

An emitter emits electrons in response to an electrical signal. Controlling these emissions forms a basis to create useful electrical and optical effects. For example, emissions can affect various media to produce memory and display effects, or be used for electron-beam lithography to produce submicron features in wafers to form microelectronic circuits. Production of focused beams involves the fabrication of an emitter and focusing structure, typically an electrostatic lens.

Emitter surfaces are sensitive to surface conditions and to processing of the emitter surface or processing on the emitter surface. This sensitivity extends across the spectrum of different types of electron emitters, including thermionic emitters, flat emitters such as polysilicon emitters, MOS (metal-oxide-semiconductor) emitters, MIS (metal-insulator-semiconductor) emitters, and MIM (metal-insulator-metal) emitters. This list also includes emitters based on different types of carbon films (nanodispersed carbon, diamond-like films, carbon nanotubes) as well as silicon tips and Spindt tip emitters. Fabrication of lenses and other structures on the emitter substrate can damage the surface or leave a surface that is not clean. Damage or excess material can harm emitter performance attributes, such as uniformity of emission over a given area or the amount of emission from a given emitter. Delivered current and emission uniformity are important parameters for all kinds of vacuum electron sources, and are critical parameters in high frequency and/or precision e-beam devices. Emission uniformity is especially important for applications such as memory storage and lithography, and the amount of emission obtained is very important for memory storage devices.

Various emitter driven devices, such as memories and displays, make use of a target anode medium. The target anode medium is the focus point for the controlled emissions of electrons. A target anode medium is held at hundreds of volts differential from the emitter/cathode structure. A strong "pull-down" attraction therefore exists between the target anode and emitter cathode. This phenomenon manifests strongly in devices having small medium-to-emitter distances, especially where large areas and high applied differential voltages are concerned.

Alignment and focusing length are also important issues in emitter driven devices. Fabrication of lenses on emitter substrates requires the precise alignment of the emitters and the focusing elements. Many high precision alignments are required to properly align a focusing lens with the emitter. With the addition of each focusing element on an emitter substrate, there is also processing complexity, e.g., deep etches that must be stopped at the emitter without damaging or changing the surface of the emitter. The focusing length is also limited to the short distance afforded by the separation of various metal layers in an emitter/focusing lens substrate.

SUMMARY OF THE INVENTION

An emitter device of the invention includes a focusing array with plural focusing columns to focus electron emissions from one or more emitters onto a target medium. Relative movement between the target medium and the focused emissions allows each focusing column to focus emissions over an area of the target medium encompassing the movement range.

In a preferred embodiment, separate emitter, focusing array and target medium substrates are used for the manufacture of the preferred device.

DETAILED DESCRIPTION OF THE INVENTION

Figure 1:
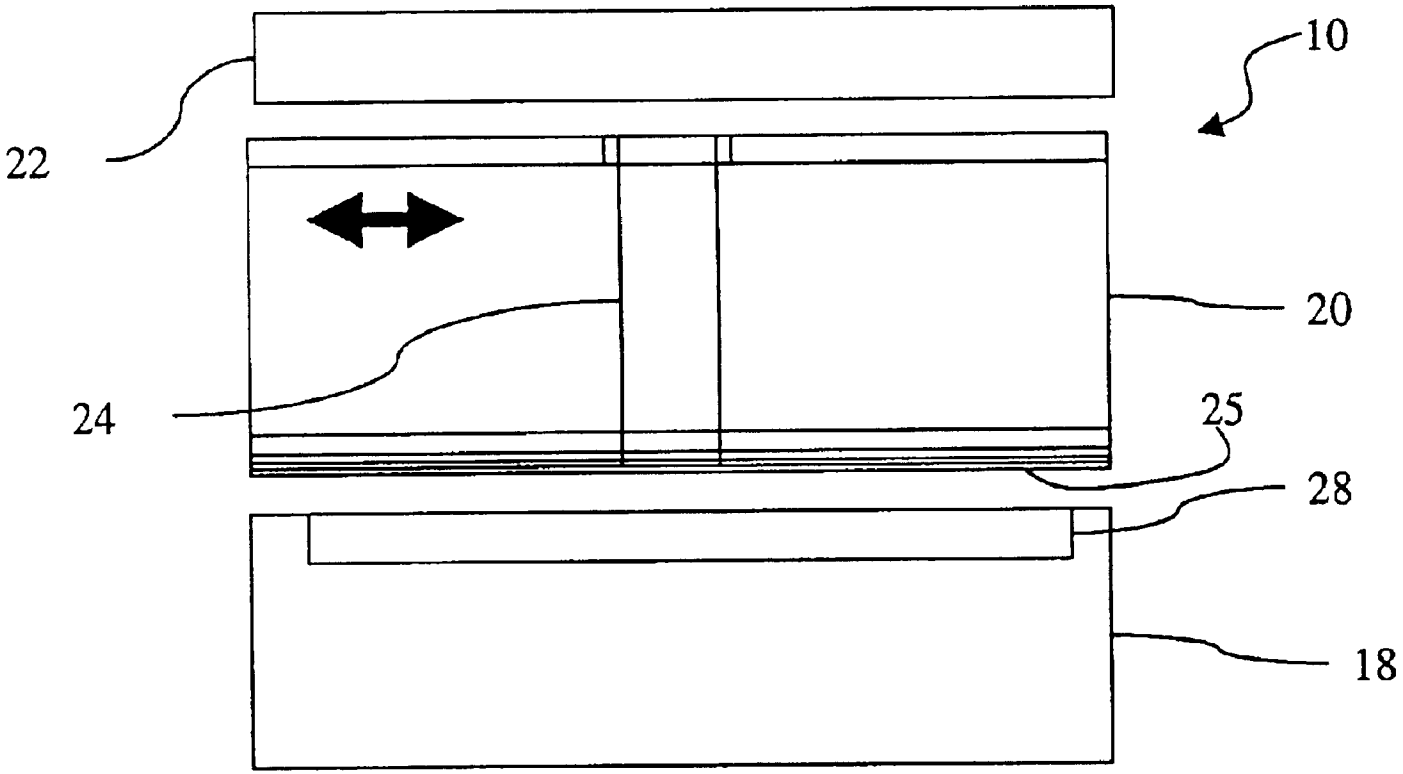
FIG. 1 is a preferred embodiment emitter device.

The present invention concerns an emitter device having a focusing array containing a plurality of focusing columns to focus electron emissions from one or more emitters onto a target medium. Relative movement between the target medium and the focused emissions allows each focusing column to focus emissions over an area of the target medium encompassing the movement range. The use of a separate focusing array according to the invention permits simplification of the structure of the emitter, provides the ability to increase the complexity of the focusing column (permitting better focus of the electron beam), reduces electrostatic interaction between the target medium (anode) and the emitter stack (cathode), and enables astigmatism correction of the electron beam and the ability to redirect the beam for either the illumination of different areas of the medium or for blanking of the electron beam. Additionally, the present invention offers flexibility to various devices by working with either single emitters or with arrays of emitters addressed as a group, permits the placement of integrated electronics and control onto a substrate carrying the focusing array, and allows for the operation of a continuous-on emitter or group of emitters.

In a preferred method of the invention, separate substrates are used for the formation of the emitter array and for the focusing array. In this manner, the separate focusing array permits the reducing of processing on sensitive emitter and media surfaces. When portions of a device are integrated, the emitter and media surfaces are exposed to minimal processing, for example, to bond a formed focusing array substrate to a separately formed emitter substrate. Most processing is conducted on non-sensitive surfaces, avoiding contamination of the media and the emitter substrates. Uniformity of the electron emission across a wide emitter or an array of emitters is then more easily obtainable than when the focusing structures are formed on the emitter substrate.

With a separate focusing array, the focusing array can provide the surfaces and area to facilitate integration for device electronics. The focusing array can itself become more complex due to less stringent requirements for surface processing and the increase in surface area on the focusing array substrate.

One of the features that may be introduced onto the focusing array substrate is the capability to reduce or eliminate pull-down forces resulting from the high voltage potential difference between the target medium and the emitters. The act of placing a focusing array between the emitters and the target medium itself reduces much of this pull-down interaction force between the two substrates, especially when the focusing array is built on a thick, i.e., at least 5–10 $\mu$m, dielectric material. By placing shielding on either surface of the focusing column, elimination of the pull-down force can be accomplished by 'matching' the potential of the surface that the shield faces (in the case of the emitter, a more negatively biased shield, in the case of the target medium, a more positive shield).

The focusing array may also be used to control the driving electronics for beam blanking, astigmatism correction and beam re-direction. The invention may be used with various types of emitters, including, for example, Spindt tip emitters or field emission arrays to achieve current density goals for a particular device application. It is preferable to avoid integration of features other than those necessary to stimulate emissions from the emitter substrate to enhance performance of the emitters; however, embodiments of the invention include use of the focusing array as a second lens with an emitter substrate lensing structure. Additional embodiments include multiple focusing arrays between the emitter and the target.

In a preferred embodiment, separate emitter, focusing array and target medium substrates are used. The focusing array substrate preferably includes integrated circuitry for device control. The focusing array may be moveable, or in a particularly preferred embodiment, is affixed to the emitter substrate, in which case either the target medium substrate is movable, or the beam is directed through circuitry and focusing located on the focusing array substrate.

The invention will now be illustrated with respect to preferred embodiment emitter devices and representative devices incorporating the preferred embodiment emitter devices. In describing the invention, particular exemplary devices, formation processes, and device applications will be used for purposes of illustration. Dimensions and illustrated devices may be exaggerated for purposes of illustration and understanding of the invention. A single emitter device illustrated in conventional fashion by a two-dimensional schematic layer structure will be understood by artisans to provide teaching of three-dimensional emitter device structures. Devices and processes of the invention may be carried out with conventional integrated circuit fabrication equipment, as will also be appreciated by artisans.

Figure 2:
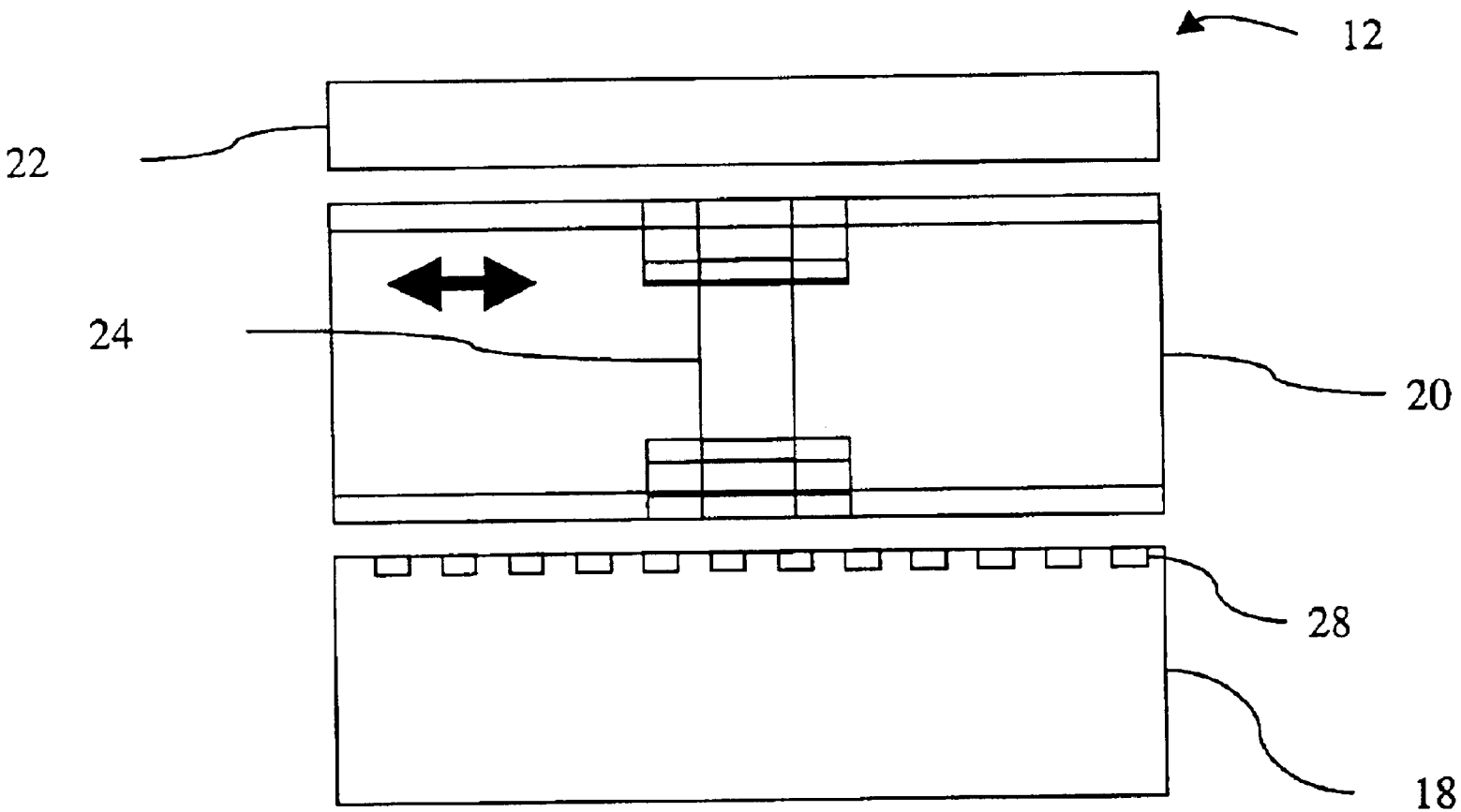
FIG. 2 is a preferred embodiment emitter device.

Referring now to FIGS. 1–4, preferred embodiment emitter devices 10, 12, 14 and 16 of the invention are shown in a two-dimensional schematic cross section. The embodiments are addressed together as they share common features labeled with like reference numerals. In the preferred embodiments, emissions from an emitter substrate 18 are focused by an electrostatic focusing array substrate 20 onto a target medium 22. Relative movement between the target medium 22 and the focusing array substrate 20 permits each of a plurality of focusing columns 24 to focus electron emissions over an area of the target medium encompassed by the range of relative movement. In each of FIGS. 1–4, the focusing column represented is an exaggeration of each focusing column within an array of columns. In FIGS. 1 and 2, the focusing array substrate 20 is movable by a micromover (unshown), while in FIGS. 3 and 4, the target medium 22 is movable by a micromover 23*a*, 23*b*. Exemplary micromovers include, for example, springs, piezo, screw and comb micromover assemblies.

Figure 3:
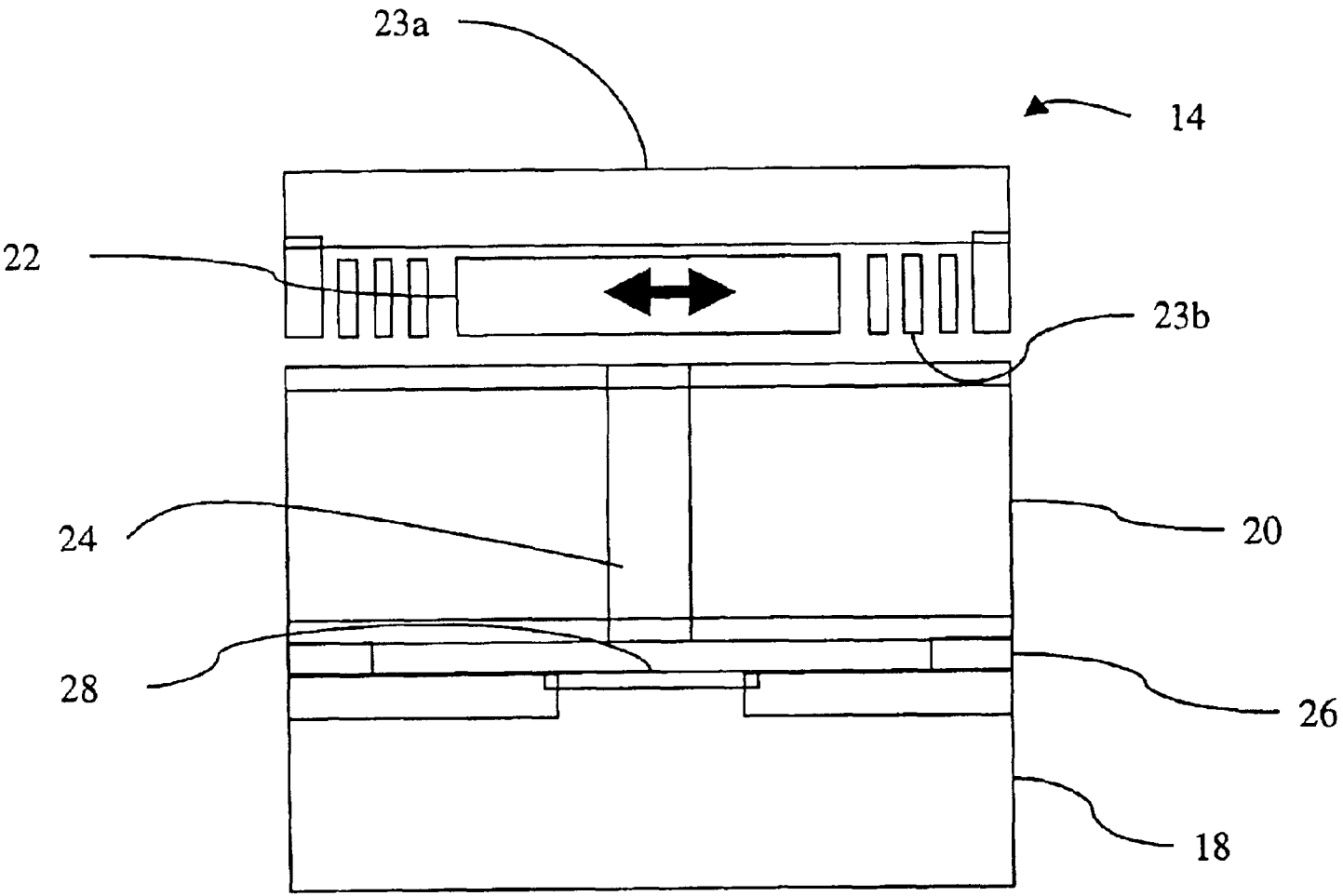
FIG. 3 is a preferred embodiment emitter device.
Figure 4:
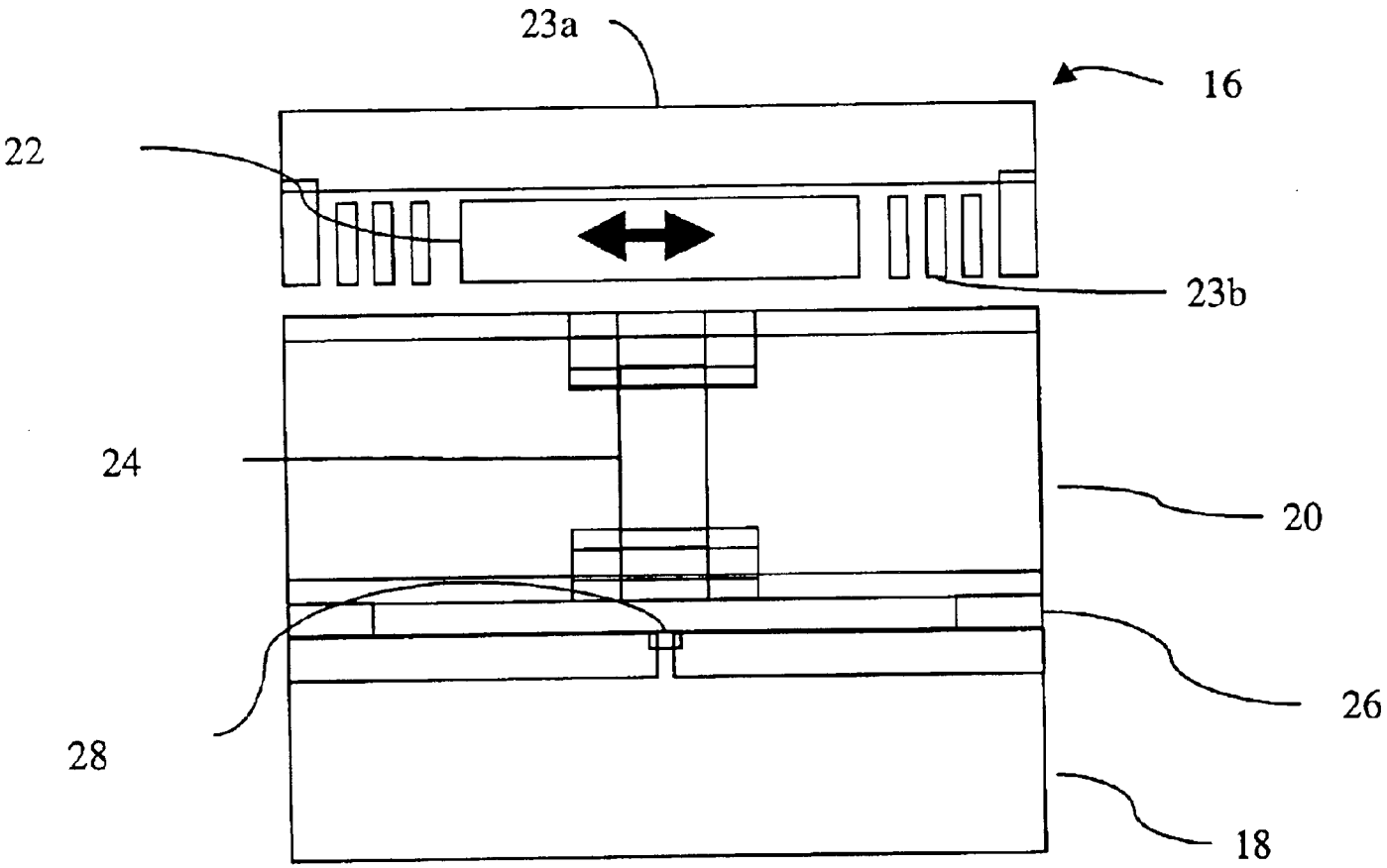
FIG. 4 is a preferred embodiment emitter device.

The separate focusing array substrate 20 of the invention is advantageous, whether it forms a movable rotor as in FIGS. 1 and 2, or is bonded through a bond 26 to the emitter substrate 18 as in FIGS. 3 and 4. It is desirable to have an emitter substrate that provides a uniform emission on one side of the emitter or emitter array when compared to the other side of the emitter or emitter array. This is facilitated by the separate focusing array substrate since there is no need to worry about apertures or lensing to be placed over the emitter substrate 18. On-substrate formation of such structures can contaminate the sensitive emitter surfaces. Control of the emitters is also removed to the focusing array substrate 20 in accordance with preferred embodiments. The focusing array substrate 20 can be used to blank emitter signals, permitting the emitter or emitters to be pulsed or continuously on, and removing the need to provide circuitry to individually address the emitters. The focusing array substrate 20 has benefits separate from protection of emitter surfaces from processing. Specifically, for example, more sophisticated focusing is possible and emitter quality detection systems can be implemented. Accordingly, embodiments of the invention include emitter devices with emitters having traditional on substrate lensing and control combined with further focusing by a focusing array of the invention.

Micromover 23*a*, 23*b*, for example, includes a stator 23*a* that interacts with media 22 as a rotor. A movement range, e.g., ±50 $\mu$m, is permitted by control of an electric or magnetic field and limited by the force of springs 23*b*. In FIGS. 1 and 2 the focusing array substrate 20 is the rotor, and it is preferred that the medium 22 is a stator providing electric and/or magnetic fields for interaction. Springs are preferably mounted to the focusing array substrate 20 on the sides of the substrate. However, the electric and/or magnetic fields to control the micromover when the focusing array substrate 20 is part of a movable rotor may be integrated either on the target medium 22 or on the emitter substrate 18.

Preferably, the micromover 23*a*, 23*b* and/or its rotor assembly is integrated with the target medium 22.

The emitter substrate 18 may make use of various types of emitters, though flat emitters are generally shown in FIGS. 1–4. For example, in FIG. 1, a large flat emitter 28 (e.g., >40 $\mu$m×40 $\mu$m) is illustrated with the focusing column 24 being narrower and translating wide electron emissions from the flat emitter 28 into a focused beam. The flat emitter 28 might be, for example, a MIM (metal-insulator-metal), a MOS (metal-oxide-semiconductor), or a MIS (metal-insulator-semiconductor) emitter. A large spindt tip array, silicon nanotip array, or carbon film emitters are additional examples, and the sensitive tip structures would benefit from avoiding the processing necessary to integrate further structures onto a common substrate. Other emitters that may be used include thermionic emitters and Schottky emitters. An emitter can be chosen based upon performance parameters, e.g., amount of desired current, required stability of emissions, and emitter lifetime. The mode of operation may also affect selection for the type of emitter. In any of the FIGS. 1–4 embodiments the emitter(s) can be run in many different modes, from continuous electron emission to pulsed emission. This gives control over any RC constant limitations and helps to improve emitter lifetime by selecting a mode that best suits the lifetime needs of the emission device. Also, the emitters do not have to be singly addressed and may be controlled as a group in either pulsed or continuous operation. In a preferred embodiment, the pulsed group control of the emitter substrate 18 is synchronized with the movements of the focusing array substrate 20 (in FIGS. 1 and 2) or the target medium 22 (FIGS. 3 and 4).

In most applications, it is preferred that emitter substrate 18 remain simple. However, the invention may also be used with an emitter that has an integrated lens, and the focusing array substrate 20 would then provide additional refinement of the electron beam. Similarly, multiple focusing array substrates 20 may be used sequentially to achieve further refinement of the focused electron beams.

Alignment between the focusing array substrate 20 and the emitter substrate 18 is less stringent than required for the alignment of an integrated emitter/lens substrate. In each of FIGS. 1 and 3, focusing columns 24 are narrower than the emitters 28, and a plurality of the focusing columns 24 divides emissions into a plurality of beams. In FIGS. 2 and 4, focusing columns encompass one or a plurality of emitters 28 arranged in an array, and focus received emissions.

The target medium 22 can be chosen to create different types of devices. The target medium 22 may be a memory medium with the use of phase change material, an exemplary material being $In_2Se_3$. Other phase change materials are known to those skilled in the art. A medium that produces visual emissions in response to electron emissions creates a display. For a lithography application, an electron beam resist material is suitable, e.g., polymethylmethacrylate (PMMA). Movements of the target medium 22 or the focusing array 20 are controlled according to the lithographic pattern desired. By pulsing of the emitters or the use of a blanking function on the focusing array substrate 20, a lithographic pattern can be written through the PMMA or any other appropriate electron-beam resist and developed for the desired pattern. A plurality of focusing columns 24 can carry out a parallel lithography application to pattern multiple target mediums or areas of the same medium with a common pattern. Different patterns or variations in the same pattern are also possible, since focusing columns 24, for example, may be individually controlled with certain columns providing the necessary focusing to achieve lithography and others blanking the electron emissions at the same time.

Blanking is but one possible operation of the focusing array substrate 20. Focusing, as used herein, encompasses the range of possibilities including, for example, mere use of an aperture. With the focusing array substrate 20 being separate from the emitter substrate 18, a range of lensing systems from simple apertures to a complex lensing system for better focusing of the electron beam can be implemented. Divergence control is relatively unimportant since in preferred embodiments, only focused electron beams pass through the lensing system of the focusing array substrate 20, or a highly collimated beam passes through the lensing system. Divergence may be eliminated (controlled) either through the lensing system or with an aperture that can be built before, or through the length, of the lensing system.

The potential for integration of electronics on the focusing array substrate 20 provides additional functions. For example, current detection devices may be placed on the focusing array substrate 20 to follow the health and lifetime of the emitters 28. A sensing device could be implemented to monitor thermal conditions and initiate pulsing (to cool down thermal buildup problems) or as a signal indicating that a given emitter array is failing and initiating precautions to ensure integrity of the data. Since the focusing array is formed as a thick substrate, reduction of attraction between the differential potentials of the emitter substrate 18 and the media substrate 22 occurs. A thick substrate refers to a substrate with minimum dielectric thickness from 5–10 $\mu$m. Dielectric thickness may range from the minimum up to hundreds of micrometers. A preferred example is a typical silicon wafer with a thickness 200, 475 or 625 $\mu$m. Furthermore, through strategic placement of shielding 25 on the focusing array substrate surfaces, elimination of pull-down forces can be obtained by matching the potential of shielding layers on the emitter substrate 20 to the potentials of the surface that it is facing. The shielding 25 (see FIG. 1) and the dielectric both act as a voltage barrier to reduce pull down. The shielding will be most effective. Some preferred embodiments of the focusing array will now be addressed.

Figure 5:
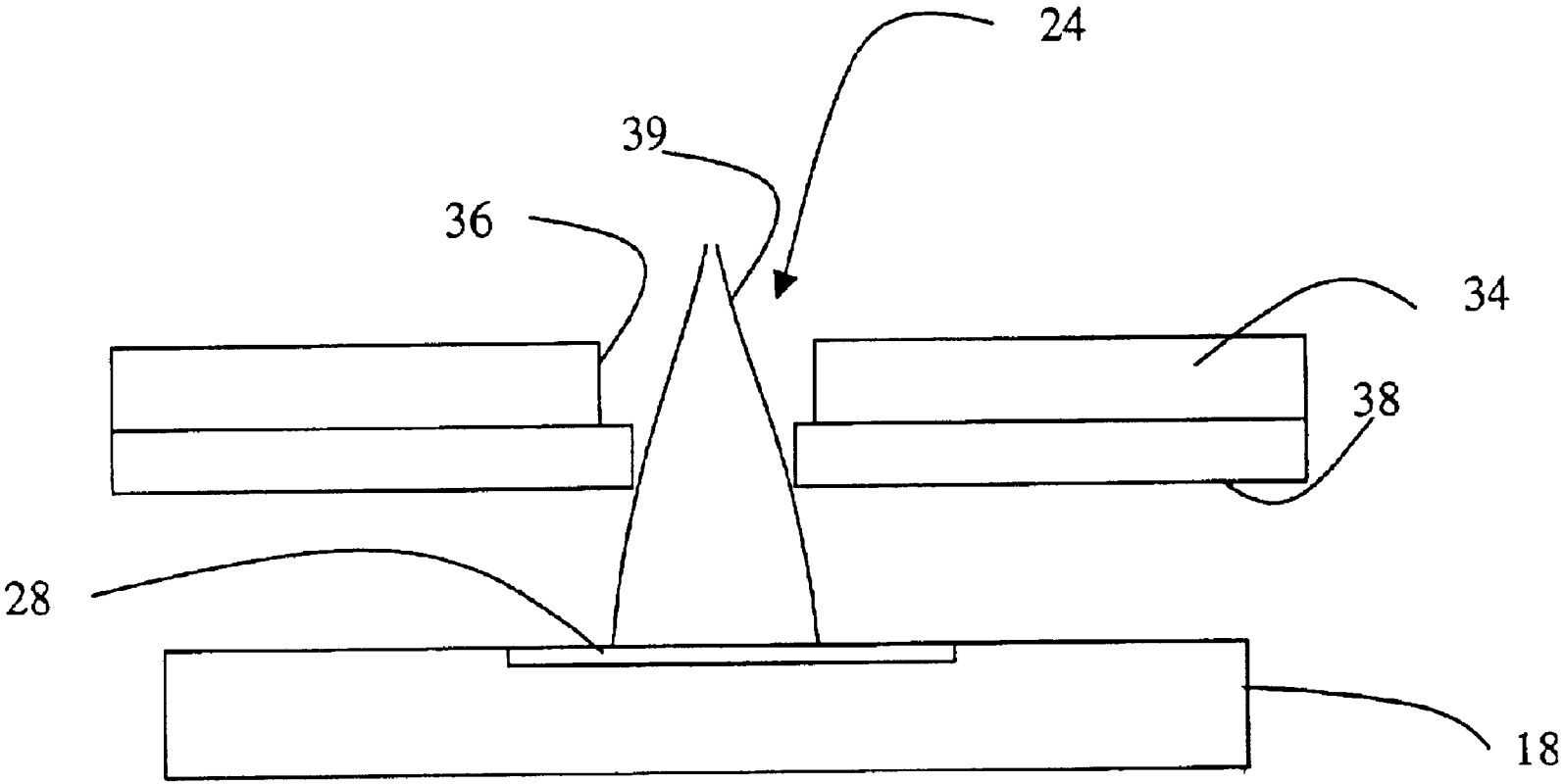
FIG. 5 is a single lens structure for a focusing array in a preferred embodiment emitter device of the invention.
Figure 6:
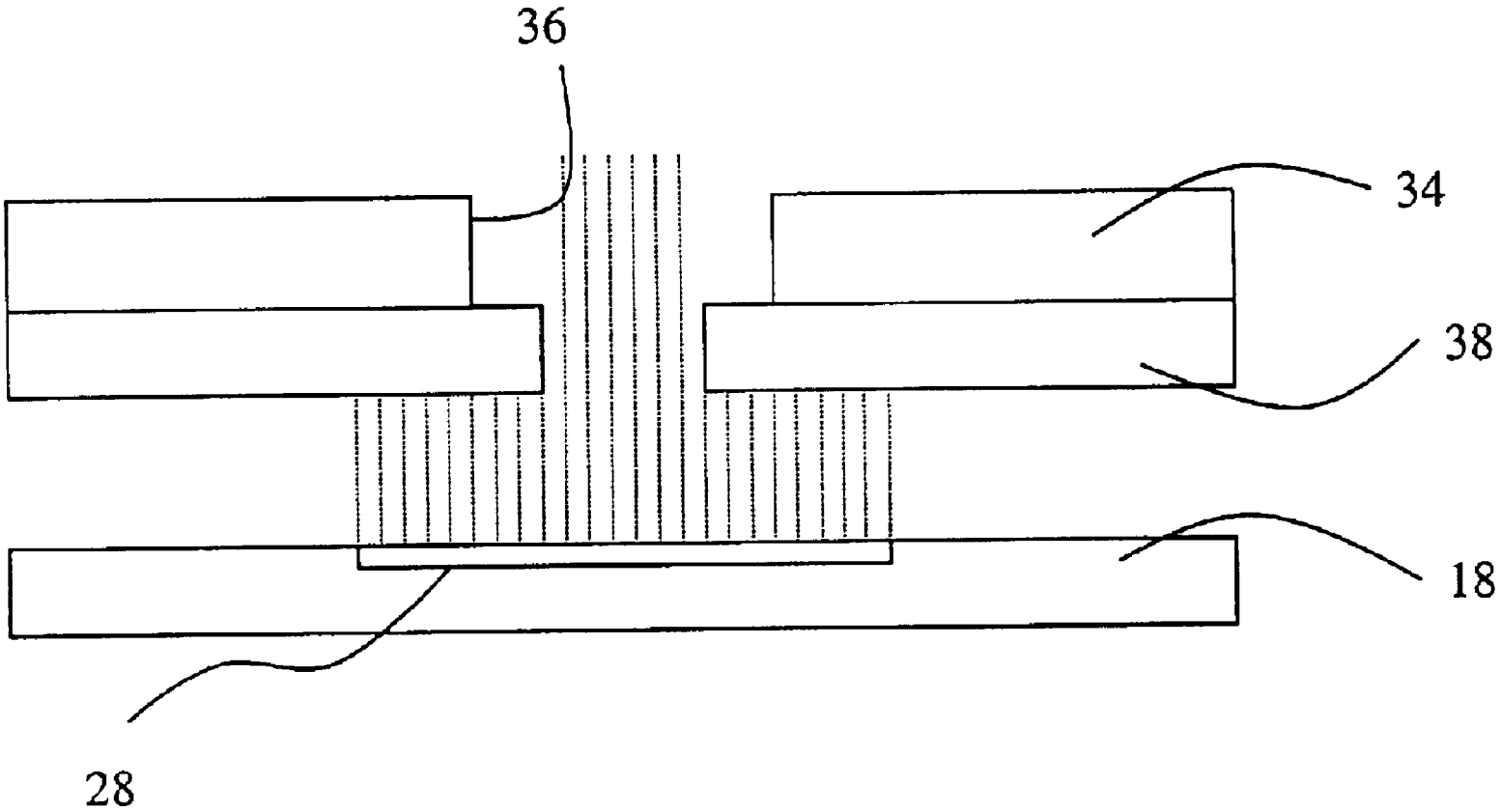
FIG. 6 is a single lens and aperture structure for a focusing array in a preferred embodiment emitter device of the invention.

FIG. 5 illustrates a simple embodiment for the focusing column 24 of the focusing array substrate 20. The FIG. 5 structure is a single lens structure, where the lens itself acts as an aperture. A wafer, e.g., a silicon or glass wafer 34 is feed-through etched to create a hole 36. An electrode 38 forms an electrostatic lens that creates a field to focus electron emissions into a tight beam 39 that will create a spot on the target medium 22. Suitable materials for the electrode 38 include refractive metals and conducting ceramics. In the FIGS. 1–4 embodiments, for each focusing column 24, an area of focus exists on the target medium due to the relative movement and positioning between the target medium 22 and the focusing column 24. In FIG. 5, only the focusing column 24 is illustrated, while artisans will appreciate that the silicon wafer 34 or other suitable substrate provides the basis for integration of other devices and circuitry. In FIG. 5, the opening defined in the electrode 38 also acts as an aperture having the same width as the focusing column 24. An operational variation is shown in FIG. 6, where the electrode 38 merely forms a reduced width aperture when no bias is applied to the electrode.

Figure 7A:
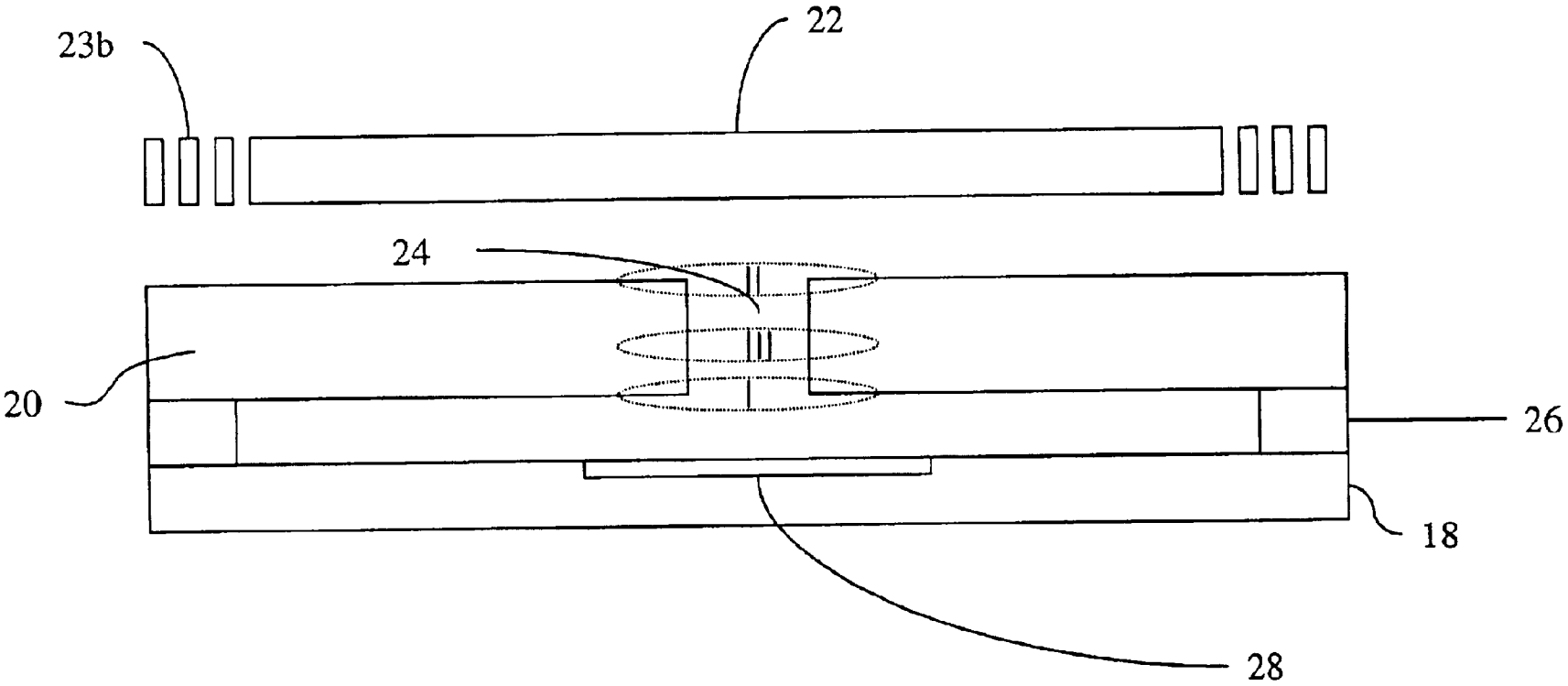
FIG. 7A illustrates the general structural framework for constructing alternate preferred embodiment focusing array structures.
Figure 7E:
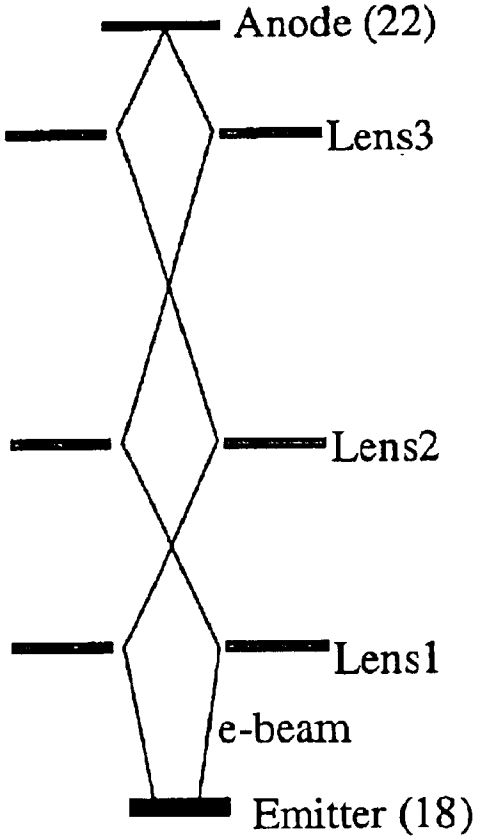
FIGS. 7B–7E schematically illustrate exemplary focusing schemes for alternate embodiment focusing array structures.
Figure 7D:
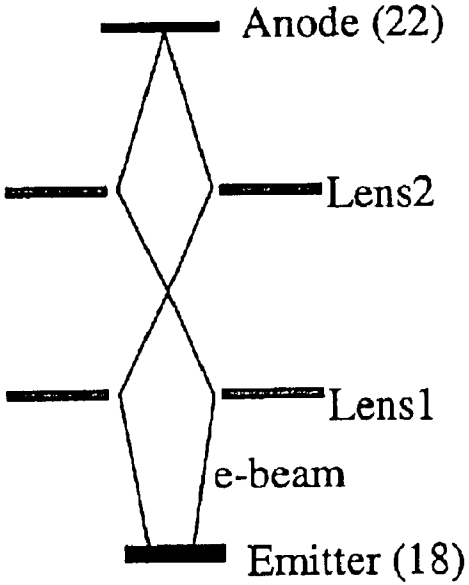
Figure 7B:
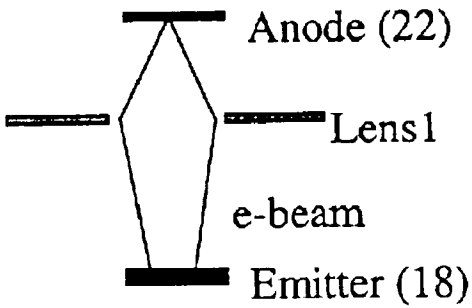
Figure 7C:
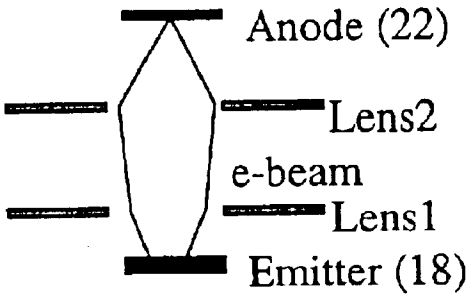

Referring now to FIG. 7A, an alternate preferred focusing array structure is illustrated as including three sections I, II and III, section I being closest to the emitter substrate 18, 11 being closest to the medium 22, and III being in the middle portion of the focusing column array substrate 20. The overall structure of the FIG. 7A embodiment is based on FIG. 3 and uses like reference numerals. This convention of naming three separate sections is adopted not as a limitation of the preferred embodiment, but only as an aid to illustrating some preferred lensing structures for the focusing array substrate 20. Functions for the different sections can be tailored to suit particular applications. FIGS. 7B–7E illustrate some preferred exemplary focusing functions that can be accomplished by using the general FIG. 7A structure to suit particular applications. FIGS. 7B and 7C illustrate a no-crossover scheme with one or two lenses, respectively. FIG. 7D illustrates a crossover scheme with two lenses. Finally, FIG. 7E illustrates a multiple crossover scheme with three lenses. The FIG. 7E structure can be realized by multiple focusing array structures according to the FIG. 7A structure.

Figure 8:
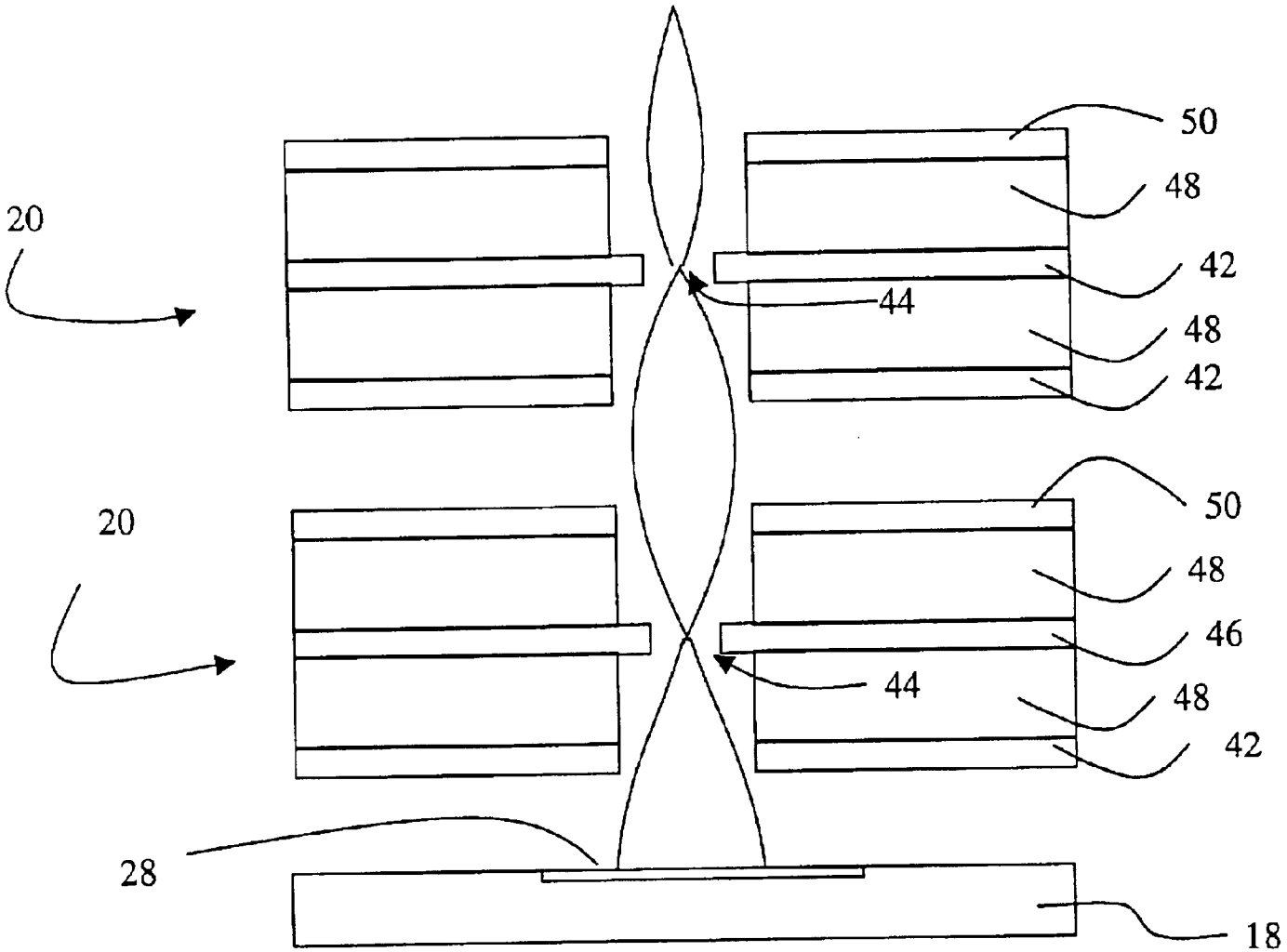
FIG. 8 is a preferred embodiment lens and dual aperture focusing array structure.

FIG. 8 illustrates such a preferred structure for implementing more than one focusing array substrate 20 and utilizing all three sections as illustrated in FIG. 7A. This schematic is used to illustrate the possible utilization of multiple focusing array substrates 20 and the use of various combinations of focusing elements within each focusing column.

The emitter substrate 18 contains an emitter 28 that may consist of a flat emitter or a tip emitter and may also consist of an array of emitters or just a large area type of emitter. The electrons emitted from the emitter 28 are preliminarily focused by the initial electrode 42, which is preferably negatively biased (thus reducing the interaction between the target medium 22 and the emitter substrate 18 as well as providing focusing capability) and used as an initial focusing lens. At a crossover region 44, an aperture 46 eliminates divergent or stray electrons from the beam. A dielectric material 48 is used between electrode 42 and aperture 46, and between aperture 46 and a second (exit) electrode 50 to prevent shorting of the two materials as well as to prevent electrostatic interaction. The beam is focused into a second focusing column by the second electrode 50.

The FIG. 8 array may be implemented in one of at least two manners. The first implementation consists of the first focusing column as being defined by Region I as shown in FIG. 7A while the second focusing column is defined as being either Region II or Region III of FIG. 7A. In this case, only one substrate is needed on which the focusing array substrate is formed. A second implementation consists of the first focusing column as one wafer, with electrode 42 being in Region I, the aperture 46 being in Region II, and the exit electrode 50 being in Region III. This is then bonded to a second wafer that is similar to the first wafer. The two wafer arrangement is shown in FIG. 8. It should be obvious that many deviations from this structure are apparent, and that this illustration is only one representation of the many possible structures that may be implemented with a separate focusing lens structure.

Figure 9:
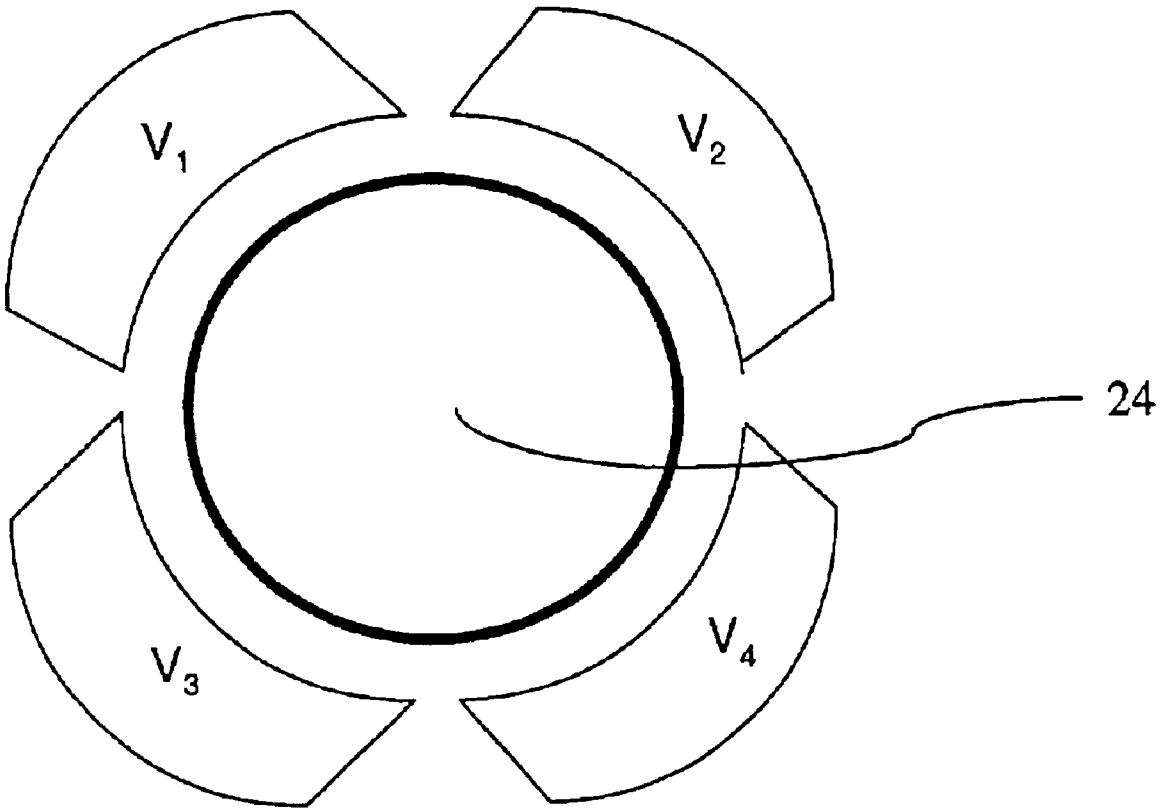
FIG. 9 illustrates a preferred embodiment electrode lens structure for beam direction control.

To illustrate some examples representing deviations of the description already provided for FIG. 8, the following may be envisioned: the electrodes 42 may be used as a blanking mechanism to control the flow of electrons through the lensing system, or the electrode 50 may be used for direction control by using a lensing system such as that shown in FIG. 9. What is important to recognize is that this invention may use multiple focusing techniques to produce highly collimated and focused electron emissions in a controlled manner to a desired region on the target medium 22.

Direction focus, e.g., beam direction control, is available for creating a potential pattern using any of the electrode layers in the preferred embodiments. A preferred example electrode pattern is shown in FIG. 9. An electrode layer around a focusing column is shown in FIG. 9 as including four separate electrodes V1 through V4. The number of electrodes or lens may be 4, 6 or 8. It should be obvious that the greater number of electrodes used, the greater the precision of beam control that can be demonstrated. Relative voltages in the electrodes/lens may be changed to adjust the point of focus of the emergent focused beam or to adjust the beam to correct for any astigmatism that may be associated with the beam. Controlled use of this effect can add to, or act as a substitute for, a limited range of relative motion between the focusing array substrate 20 and the target medium 22. The electrode pattern is usable with any of the preferred embodiment focusing array structures.

Figure 10A:
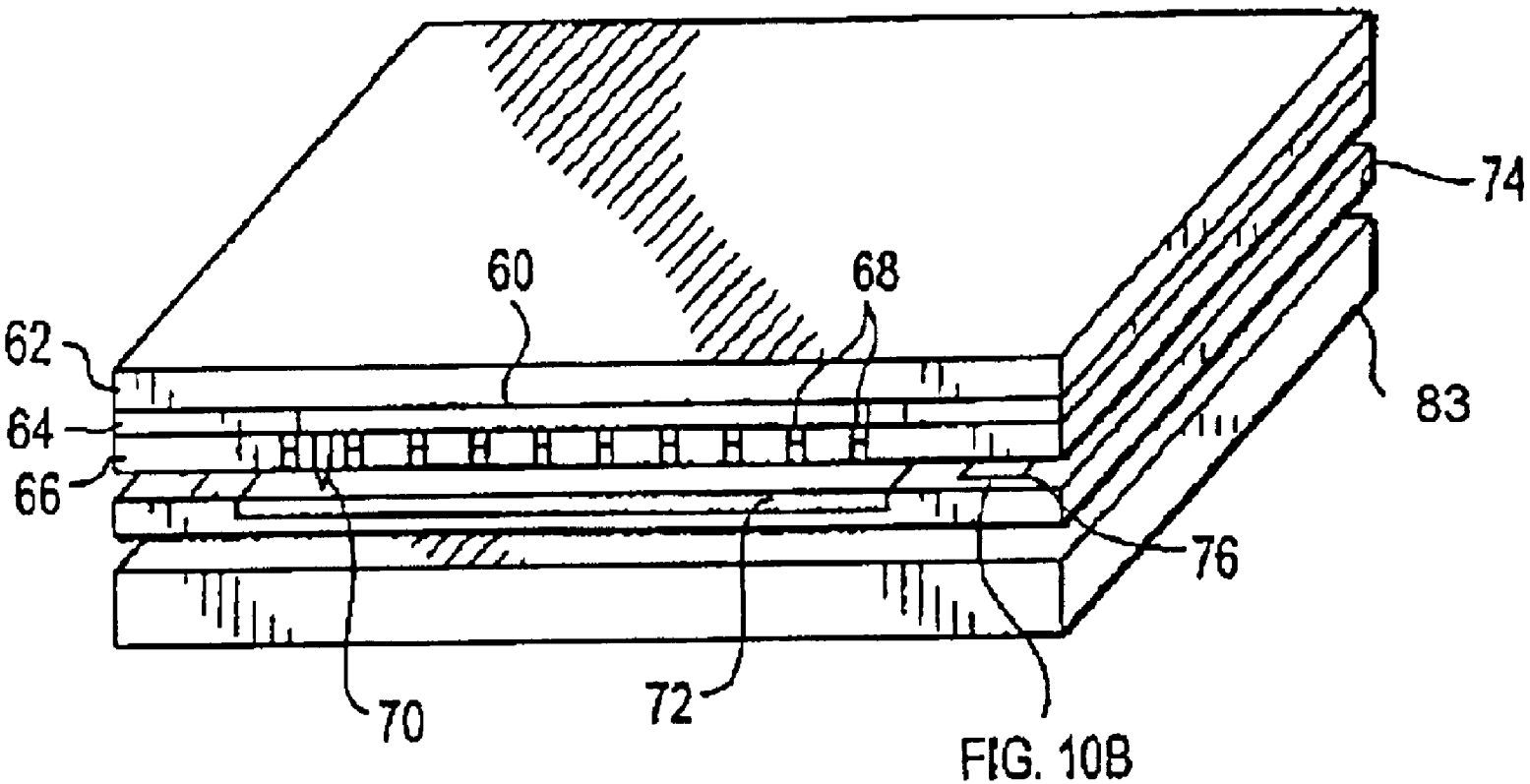
FIGS. 10A and 10B illustrate a preferred embodiment memory device of the invention.
Figure 10B:
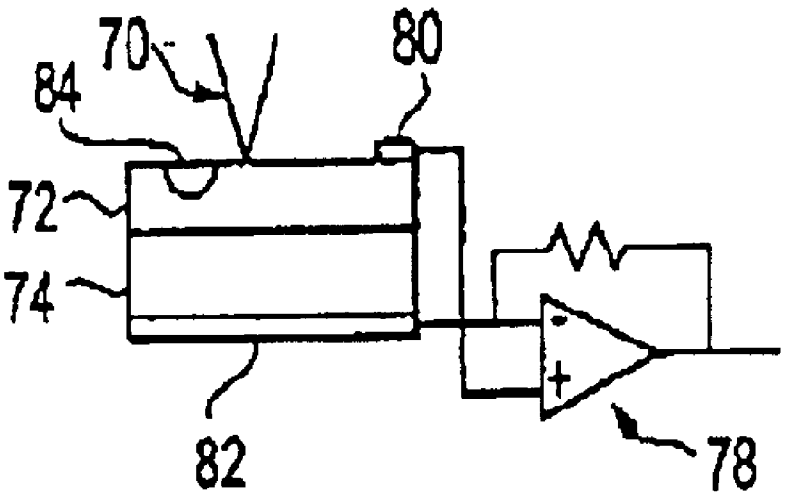

A preferred memory device is shown in FIGS. 10A and 10B. The embodiment generally has the FIG. 4 focusing array structure. The memory device includes a plurality of integrated emitters 60 on an emitter substrate 62. In this exemplary embodiment, an integrated circuit (IC) 62 including one large field or a plurality of smaller integrated emitters 60 is bonded by a bond 64 to a focusing array substrate 66 having focusing columns 68. Each focusing column 68 can controllably emit a focused beam 70 that is used to affect a recording surface, namely medium 72. Medium 72 is applied to a mover 74 that positions the medium 72 with respect to the focusing columns 68 of the focusing array substrate 66. Preferably, the mover 74 has a reader circuit 76 integrated within. The reader 76 is shown as an amplifier 78 making a first ohmic contact 80 to medium 72 and a second ohmic contact 82 to mover 74, preferably a semiconductor or conductor substrate. The mover 74 is a rotor substrate that interacts with a stator substrate 83, which contains opposing electrodes (in regard to corresponding electrodes on the mover substrate 74) for positioning the mover substrate 74 relative to the stator 83. When a focused beam 70 strikes the medium 72, if the current density of the focused beam is high enough, the medium 72 is phase-changed to create an affected medium area 84. When a low current density focused beam 70 is applied to the medium 72 surface, different rates of current flow are detected by amplifier 78 to create reader output. Thus, by affecting the medium 72 with the energy from the emitter 60, information is stored in the medium using structural phase changed properties of the medium. An exemplary phase change material is $In_2Se_3$. A preferred lithography device has the same general structure as in FIG. 10A, but omits the reader circuit and replaces the phase change material with a wafer or wafers prepared for lithographic patterning.

Figure 11:
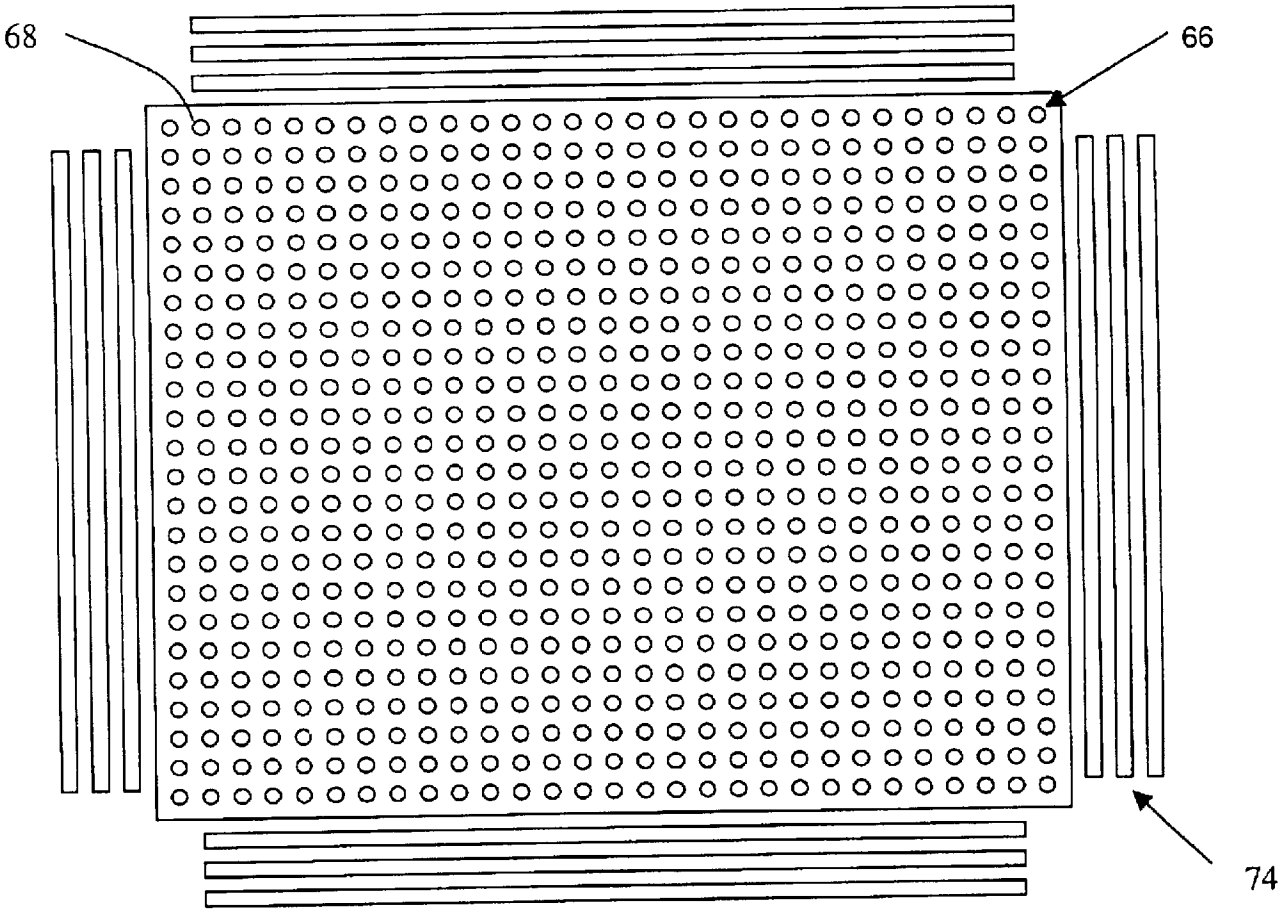
FIG. 11 is a schematic top view of a preferred embodiment focusing array and micromover.

FIG. 11 shows an alternate preferred focusing array 66, which may be used in FIG. 10A to create an embodiment where the focusing array 66 is movable instead of the medium 72. Columns 68 are aligned over an emitter array 60. Alignment with respect to emitter array 60 and a target medium is achieved by the movers 74. This same basic arrangement is useful, for example, for e-beam lithography and displays. The size of the emitter array 60 focusing array 66 and medium 72 is limited by applications only. A single focusing array 66 might align over a single wafer or a portion thereof. An exemplary 2" focusing array 66 might be positioned over a targeted medium wafer 72.

Figure 12:
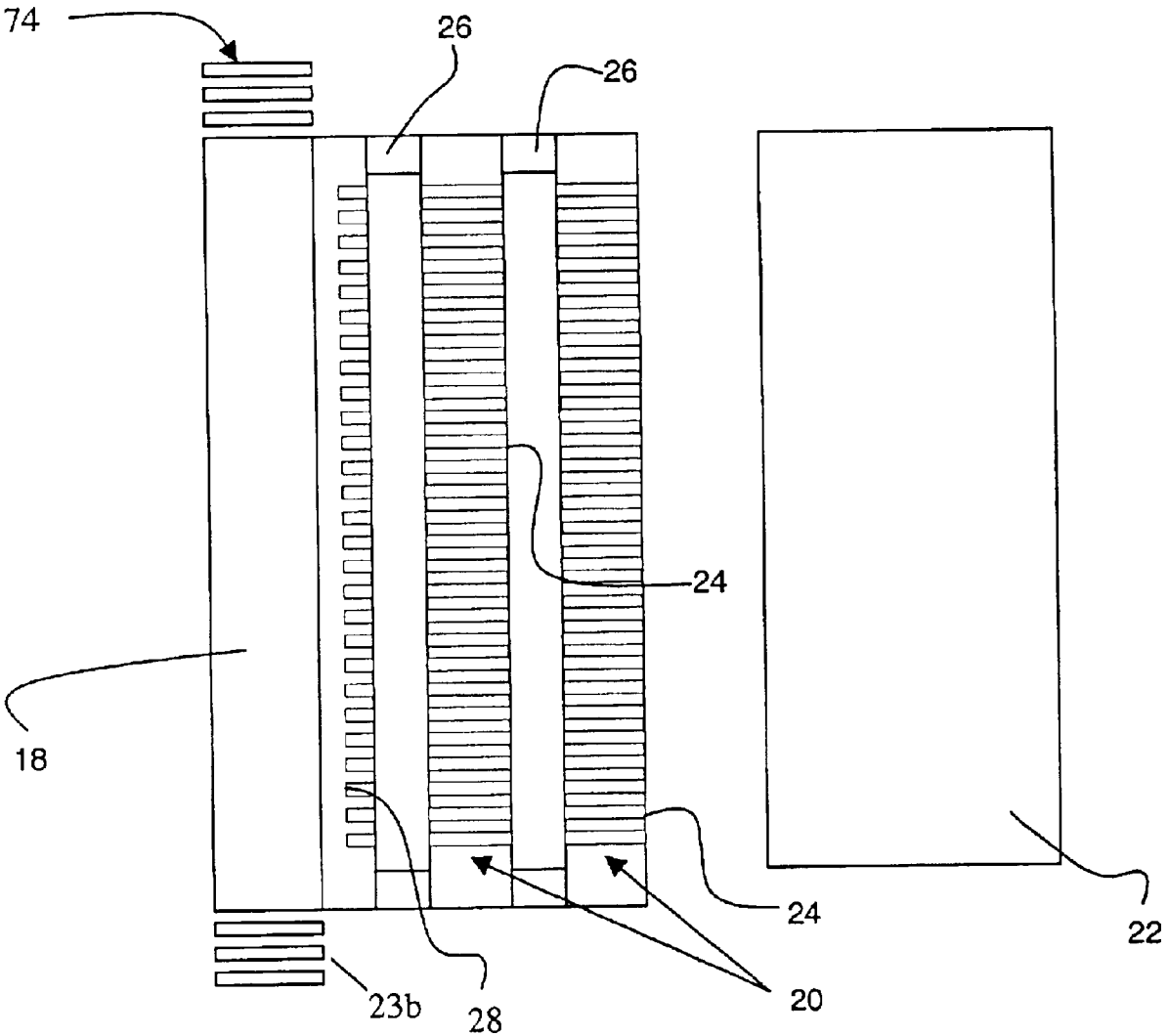
FIG. 12 is a schematic cross-section view of a preferred embodiment dual focusing array emitter device of the invention.

FIG. 12 is a cross-section schematic view of a preferred dual focusing array emitter device of the invention. Two focusing arrays 20 are bonded to each other and the emitter chip 18 through the bonds 26. The micromover 74 can create relative movement of the emitter chip/focusing array structure relative to the target medium 22. Focusing array chips 20 may have the FIG. 8 dual lens arrangement. Alternatively, any arrangement of magnetic and electrostatic functions, examples including without limitation, collimation, focus, blanking, selection, modulation, beam direction control, beam limitation (as through an aperture), and/or signal detection, is possible. The FIG. 12 structure is generally applicable to any type of device, including the aforementioned displays, memories and lithography devices. The FIG. 12 structure represents a variant of the FIGS. 3 and 4 embodiments. The focusing arrays 20 are bonded together with bonds 26 and bonded to an emitter chip 18. In this case, the emitter chip 18 and focusing arrays together form a rotor and the target medium 22 a stator. Micromover 74 is applied to the emitter chip, with springs 23*b* being integrated, for example, through the back of the emitter chip 18.

Figure 13:
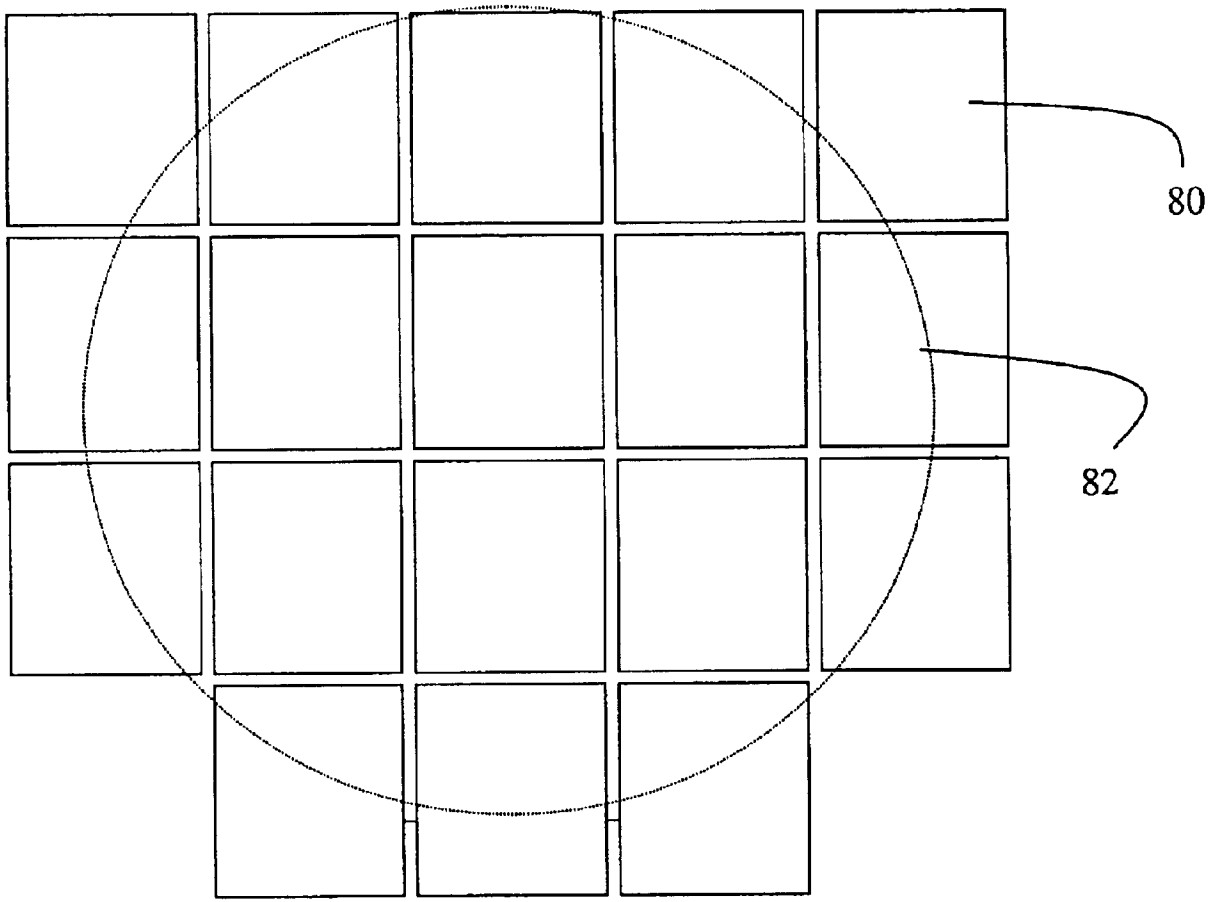
FIG. 13 is a schematic view of a preferred embodiment lithography device of the invention.

FIG. 13 illustrates an exemplary lithography arrangement, in which a plurality of bonded emitter chips and focusing arrays form e-beam generator arrays 80, and a wafer 82 is acted on as the target medium. Each e-beam generator array 80 has on it micromovers or nanomanipulators to position the array of beams over the correct area of the wafer 82. The wafer 82 can then be positioned underneath the arrays 80 to permit several patterns to be written. An alternative is to make emitter arrays large enough to each act on something as large as a full wafer to conduct full 6" (or larger) processing of the wafer underneath it. Another example is the use of multiple arrays having common movements to process a number of wafers in parallel, writing the same pattern to each wafer.

Figure 14A:
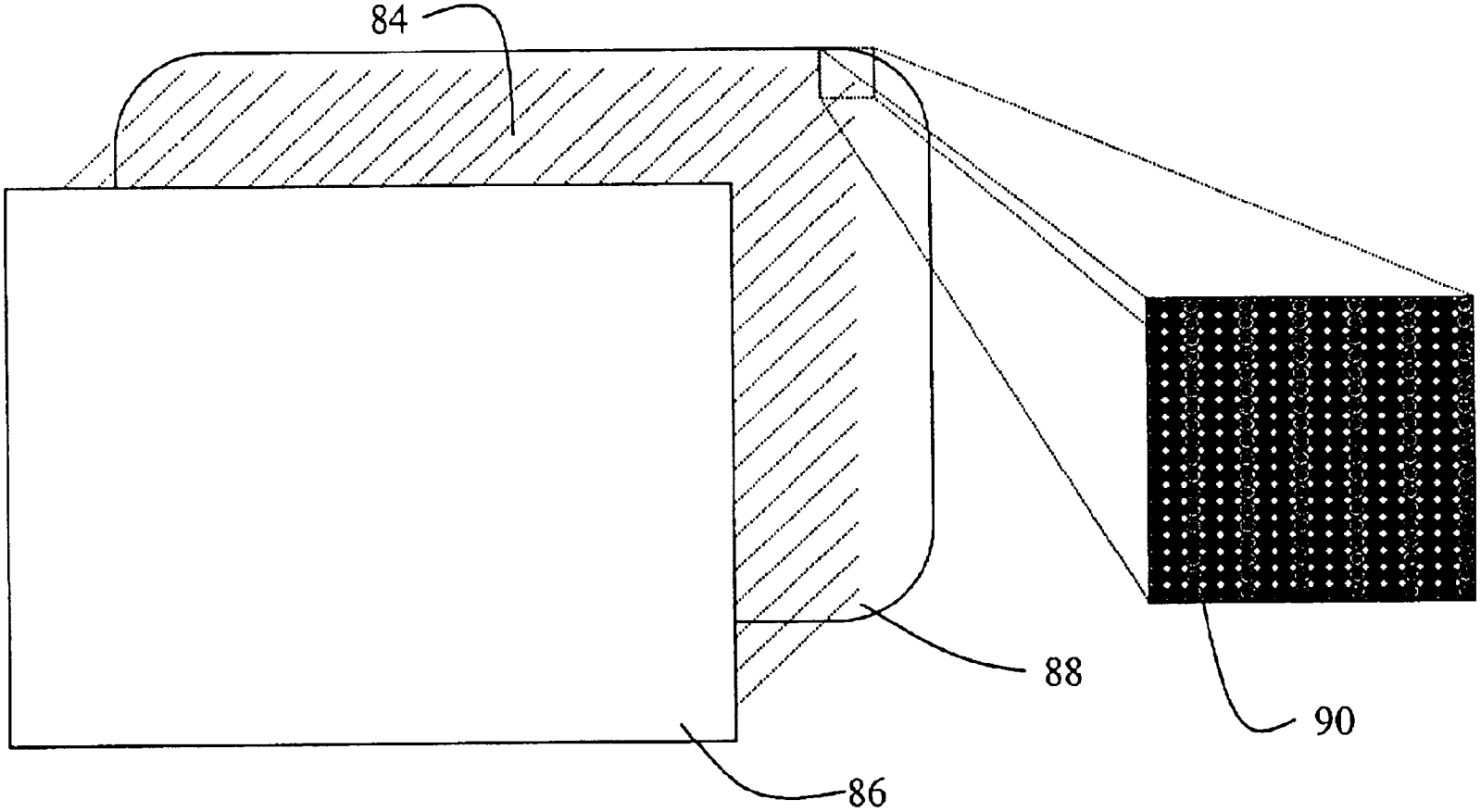
FIG. 14A is a schematic view of a preferred embodiment display device of the invention.
Figure 14B:
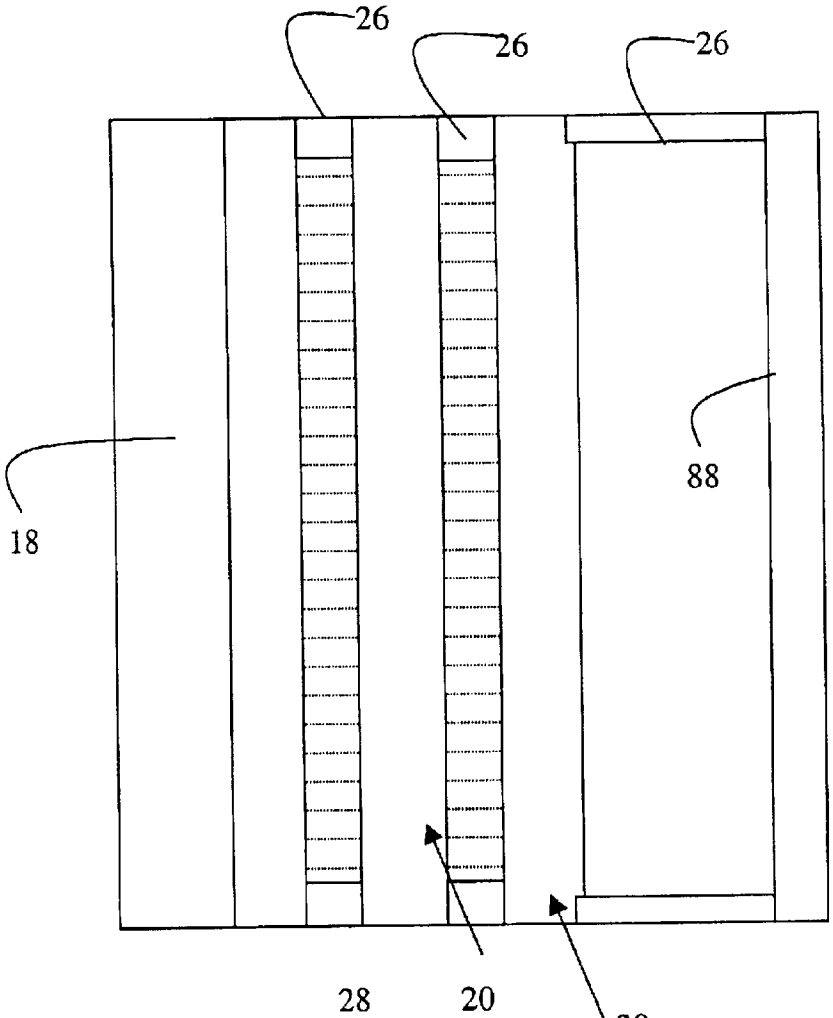
FIG. 14B is a schematic cross-section view of a preferred embodiment dual focusing array device structure, usable for the FIG. 14A display device.
Figure 14C:
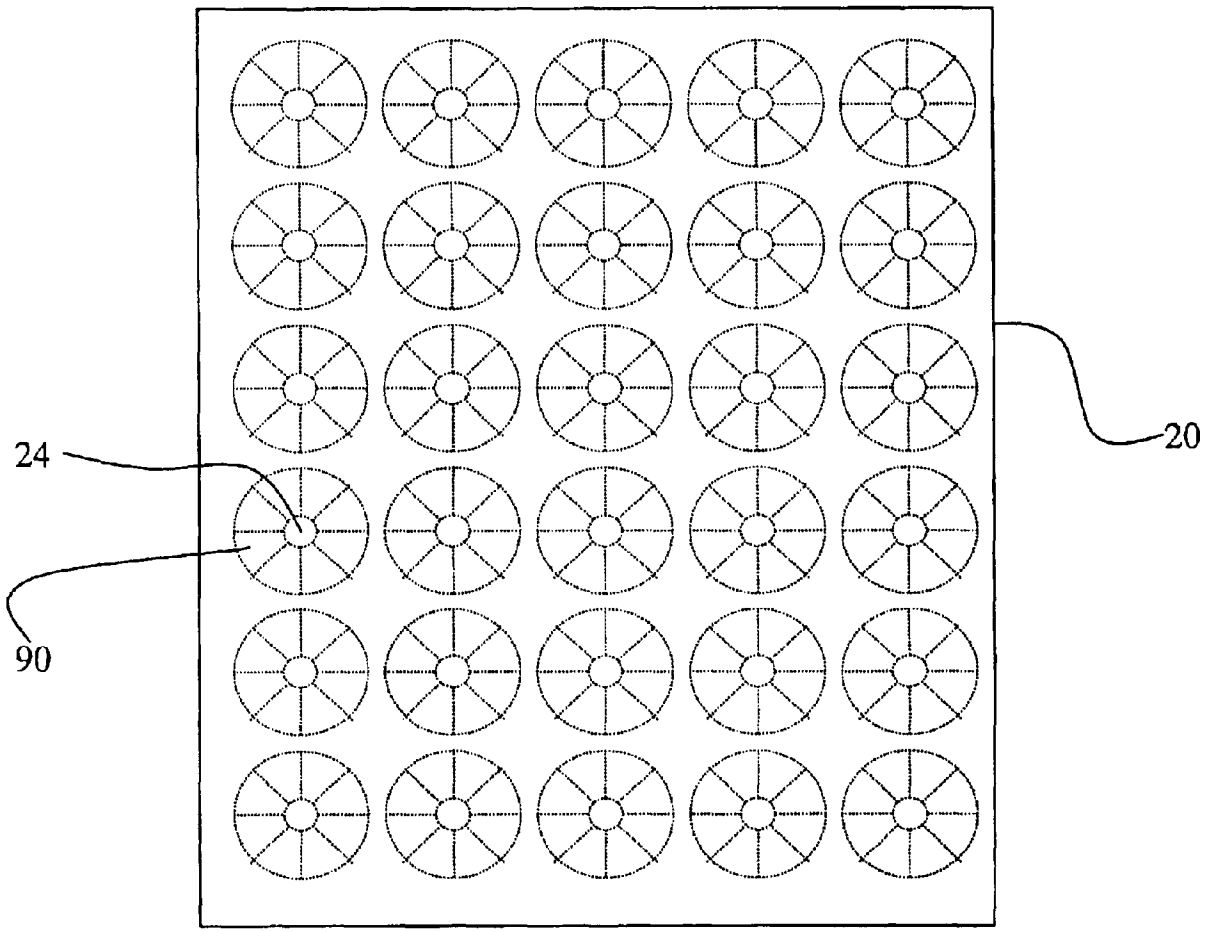
FIG. 14C is a schematic top view of a preferred focusing array for preferred embodiment beam movement control, usable for the FIG. 14A display device.

FIGS. 14A–C illustrate an exemplary display device. Referring to FIG. 14A, display generating electron beams 84 are produced by an emitter device 86 of the invention. The emitter device 86, for example, includes a plurality of bonded emitter chips and focusing array chips. Individual electron beams selectively emanate from each focusing column embodied in the emitter device 86. The electron beams 84 may be individually modulated by each focusing array column within the emitter device 86 to strike a display medium 88. The display medium 88 may include pixels 90 of different color display media, e.g., colored phosphor materials. A plurality of pixels is included within a movement range of each electron beam to permit each electron beam 84 to strike one of the different colors within its range of operation on the display medium 88. This produces a visible image in the desired colors. Each focusing array column may then be individually addressed to display the necessary images. Because this process uses individually addressed emitters, display updates are very rapid.

The movement range for an individual electron beam in the display embodiment may be small, and speed can be enhanced by limiting beam movement to a beam direction control method. In addition, it is beneficial to avoid moving parts in displays. FIGS. 14B and 14C illustrate a preferred structure to achieve a range of positions for each electron beam 84 without resort to a micromover or nanomanipulators.

In FIG. 14B, two focusing arrays 20 are bonded to each other, to the emitter chip 18 and to the display medium 88 by bonds 26. The focusing array 20 closest to the display medium 88 is preferably constructed so that each focusing column 24 in the array has a multiple electrode lens, a.k.a. beam direction control, in accordance with FIG. 9 to achieve directional control of the beam. This has been discussed with respect to FIG. 9. In the preferred embodiment, shown in FIG. 14C, each focusing column 24 includes eight electrodes 90. Application of different voltages to the electrodes 90 around a focusing column 24 change the direction of an electron beam. Preferably, a balanced voltage condition has a beam emitting from the center of a focusing column 24. The change in position of a beam, and the resultant display effect is as rapid as the change in voltage of electrodes around a focusing column. Pulsation of the emitters 28 may set a display rate. A blanking effect, used by the focusing array furthest from the display medium, may be used for rapid turn-on or turn-off of a particular pixel. Modulation or directional control of the beam may also be used for variation in the brightness of a particular display pixel. Artisans will appreciate that a full range of other effects are made possible as well.

Figure 15:
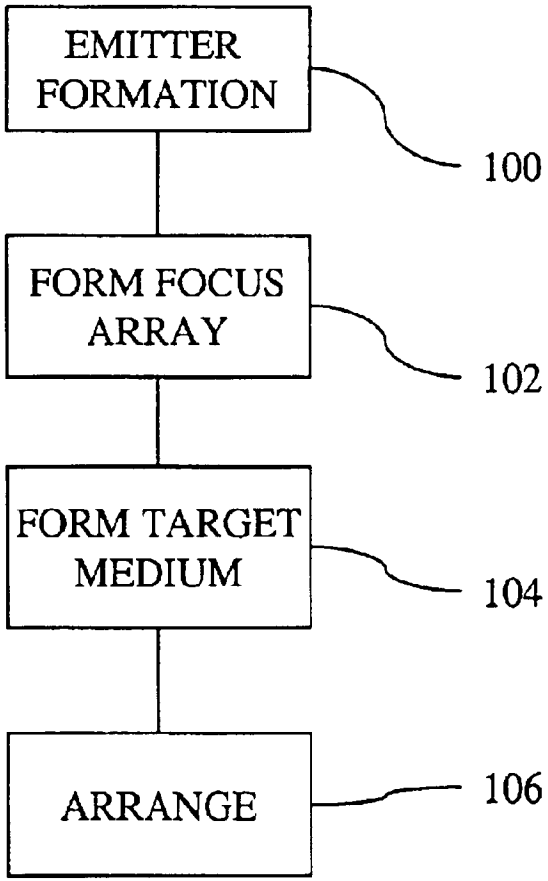
FIG. 15 is a preferred embodiment method of forming an emitter device.

FIG. 15 illustrates a preferred embodiment formation method of the invention. Concepts and advantages discussed with respect to the various devices and structures discussed above are applicable to the method. Broadly, a formation method of the invention involves the separate formation of a focusing array and emitter with subsequent arrangement of the two elements. This reduces processing on the sensitive emitter surfaces. Referring to FIG. 15, a particular embodiment of the method of the present invention begins with forming one or more emitters on the first substrate (step 100). A focusing array including one or more focusing columns is then formed (step 102) on a second substrate. Preferably, a target medium is formed on a third substrate (step 104). After the separate formations, the emitter, focusing array and medium substrates are then arranged (step 106), for example, by bonding, such that the focusing array focuses emissions from the one or more emitters through the focusing columns onto the target medium.

While a specific embodiment of the present invention has been shown and described, it should be understood that other modifications, substitutions and alternatives are apparent to one of ordinary skill in the art. Such modifications, substitutions and alternatives can be made without departing from the spirit and scope of the invention, which should be determined from the appended claims.

Various features of the invention are set forth in the appended claims.

What is claimed is:

1. An emitter device comprising:

one or more emitters an electrostatic focusing array including a plurality of focusing columns for focusing emissions from said one or more emitters into a plurality of focused beams;

a target medium for receiving said focused beams, wherein one of said target medium and said electrostatic focusing array can create controlled relative movement between said target medium arid one or more of said plurality of focused beams; and wherein said electrostatic focusing array is movable with respect to said target medium and said one or more emitters.

2. The emitter device of claim 1, wherein said one or more emitters comprises one or more emitters having an emission area encompassing multiple ones of said plurality of focusing columns.

3. The emitter device of claim 1, wherein said one or more emitters comprises an array of emitters and each of said plurality of focusing columns encompasses multiple ones of said array of emitters.

4.The emitter device of claim 1, wherein said electrostatic focusing array comprises a voltage barrier to create a low voltage potential between said target medium and said electrostatic focusing array.

5. The emitter device of claim 1, wherein said array comprises electrodes disposed around one or more of said focusing columns so that application of voltage to said electrodes can directionally control a focused beam.

6. The emitter device of claim 5, wherein said electrostatic focusing array comprises:

beam entry and exit sections each having at least one of an aperture, a single lens, a double lens, an aperture and lens structure, and a beam direction control; and a crossover section between said beam entry and exit sections, said crossover section having at least one of a collimation aperture and a beam direction control.

7. The emitter device of claim 6, wherein said electrostatic focusing array comprises a voltage barrier to create a low voltage potential between said target medium and said electrostatic focusing array.

8. The emitter device of claim 6, wherein said beam direction control comprises electrodes arranged symmetrically around circumferences of said plurality of focusing columns.

9. The emitter device of claim 1, wherein said one or more emitters comprises one or more emitters having an emission area encompassing multiple ones of said plurality of focusing columns.

10. The emitter device of claim 1, wherein said one or more emitters comprises an array of emitters and each of said plurality of focusing columns encompasses multiple ones of said array of emitters.

11. The emitter device of claim 1, wherein said electrostatic focusing array comprises a dielectric barrier to create a low voltage potential between said electrostatic lens and other portions of said electrostatic focusing array.

12. The emitter device of claim 1, wherein said electrostatic focusing array comprises one or more of a lens and an aperture.

13. The emitter device of claim 12, wherein said electrostatic focusing array comprises a beam direction control.

14. The emitter device of claim 13, wherein said electrostatic focusing array comprises:

beam entry and exit sections each having at least one of an aperture, a single lens, a double lens, an aperture and lens structure, and a beam direction control; and a crossover section between said beam entry and exit sections, said crossover section having at least one of a collimation aperture and a beam direction control.

15. The emitter device of claim 14, wherein said electrostatic focusing array comprises a dielectric barrier to prevent interaction between different sections of said focusing array.

16. The emitter device of claim 15, wherein said beam direction control comprises electrodes arranged symmetrically around circumferences of said plurality of focusing columns.

17. The emitter device of claim 1, wherein said target medium comprises a memory medium.

18. The emitter device of claim 1, wherein said target medium comprises one or more wafers and the emitter device is an e-beam lithography device.

19. An emitter device comprising:

an emitter substrate including one or more emitters controlled as a group;

an electrostatic focusing substrate including a plurality of focusing columns for focusing emissions from said one or more emitters into a plurality of focused beams;

a target medium substrate for receiving said focused; and a mover for positioning said focused beams upon said target medium substrate, said emitter substrate and said target medium substrate being stator substrates and said electrostatic focusing substrate is a movable substrate responsive to said mover.

20. The emitter device of claim 19, wherein said target medium comprises a memory medium.

21. The emitter device of claim 19, wherein said target medium comprises a plurality of wafers and the emitter device is an e-beam lithography device.

22. The emitter device of claim 19, wherein said target medium comprises a display medium and the emitter device is a display device.

23. The emitter device of claim 19, further comprising electrodes in said focusing array for beam direction control.

24. The emitter device of claim 23, wherein said target medium comprises a plurality of wafers and the emitter device is an e-beam lithography device.

25. The emitter device of claim 23, wherein said target medium comprises a memory medium.

26. The emitter device of claim 23, wherein said target medium comprises a display medium and the emitter device is a display device.

27. The emitter device of claim 26, wherein said display medium comprises a plurality of pixels and an effect is generated in a pixel when one of said plurality of focused beams Impinges upon the pixel;

each of said plurality of focused beams has its direction controlled over multiple ones of said plurality of pixels.

28. The emitter device of claim 27, wherein said multiple ones of said plurality of pixels comprise different color pixels.

29. A memory device, comprising:

a first substrate;

one or more emitters on the first substrate;

a second substrate discrete from and positioned adjacent to the first substrate;

an array of focusing columns on the second substrate adjacent to the one or more emitters on the first substrate;

a third substrate discrete from the first and second substrates and positioned adjacent to the second substrate opposite the first substrate;

a memory medium on the third substrate; and a micromover coupled to the second substrate, the micromover operable to move the second substrate relative to first substrate or the third substrate or both.

30. A memory device, comprising:

a first substrate;

one or more emitters on the first substrate;

a second substrate discrete from and positioned adjacent to the first substrate;

an array of focusing columns on the second substrate adjacent to the one or more emitters on the first substrate;

a third substrate discrete from the first and second substrates end positioned adjacent to the second substrate opposite the first substrate;

a memory medium on the third substrate; and wherein one or both of the first substrate and the third substrate are configured as a stator and the second substrate is configured as a rotor movable relative to one or both of the first substrate and the second substrate.

* * * * *

UNITED STATES PATENT AND TRADEMARK OFFICE

CERTIFICATE OF CORRECTION

PATENT NO. : 6,822,241 B2 
DATED : November 23, 2004
INVENTOR(S) : David Schut, Alexander Govyadinov and Xiaofeng Yang It is certified that error appears in the above-identified patent and that said Letters Patent is hereby corrected as shown below:

Title page,
Item [75], Inventors, please amend the third inventor's name to read as
-- Xiaofeng Yang --.

Signed and Sealed this

Fourteenth Day of June, 2005

JON W. DUDAS
*Director of the United States Patent and Trademark Office*

UNITED STATES PATENT AND TRADEMARK OFFICE

CERTIFICATE OF CORRECTION

PATENT NO. : 6,822,241 B2
DATED : November 23, 2004
INVENTOR(S) : David Schut et al.

It is certified that error appears in the above-identified patent and that said Letters Patent is hereby corrected as shown below:

Column 6,
Line 62, delete “11” and insert therefor -- II --.

Column 10,
Line 47, delete “arid” and insert therefor -- and --.

Column 11,
Line 61, after “focused” insert -- beams --.

Column 12,
Line 24, delete “Impinges” and insert therefor -- impinges --.

Signed and Sealed this

Eighth Day of November, 2005

JON W. DUDAS
*Director of the United States Patent and Trademark Office*